United States Patent [19]

Ma et al.

[11] Patent Number: 4,801,940

[45] Date of Patent: Jan. 31, 1989

[54] SATELLITE SEEKING SYSTEM FOR EARTH-STATION ANTENNAS FOR TVRO SYSTEMS

[75] Inventors: John Y. Ma, Milpitas; David H. McCracken, San Jose; Steven Weiss, Los Gatos; Albert C. Houston, III, Santa Cruz, all of Calif.

[73] Assignee: Capetronic (BSR) Ltd., Kowloon, Hong Kong

[21] Appl. No.: 792,786

[22] Filed: Oct. 30, 1985

[51] Int. Cl.[4] ..... H01Q 3/00

[52] U.S. Cl. ..... 342/359; 342/356

[58] Field of Search ..... 343/352, 359, 356, 362–364

[56] References Cited

U.S. PATENT DOCUMENTS

| | | | |
|---|---|---|---|
| 3,089,137 | 5/1963 | Pierce | 343/363 X |
| 3,093,825 | 6/1963 | Allen | 343/363 |
| 3,311,916 | 3/1967 | Packard | 343/363 |
| 3,383,688 | 5/1968 | Renaudie | 343/352 X |
| 3,523,294 | 8/1970 | Okamura et al. | 343/352 |
| 3,530,471 | 9/1970 | Mark | 343/352 X |
| 3,772,701 | 11/1973 | Wilkinson | 343/359 X |
| 3,842,420 | 10/1974 | Rabow | 343/7.4 X |
| 4,030,099 | 6/1977 | Valenti et al. | 343/7.4 X |
| 4,090,201 | 5/1978 | Whitman, Jr. | 343/7.4 X |
| 4,336,542 | 6/1982 | Bielli et al. | 343/352 X |
| 4,358,767 | 11/1982 | Boireau | 343/352 X |
| 4,418,350 | 11/1983 | Rosen | 343/352 X |
| 4,542,326 | 9/1985 | Hornback | 343/7.4 X |

*Primary Examiner*—Theodore M. Blum
*Assistant Examiner*—Mark Hellner
*Attorney, Agent, or Firm*—Stephen G. Rudisill

[57] ABSTRACT

A TVRO earth station having a satellite seeking system comprising at least one controllable motor for adjusting the position of an antenna for receiving signals from a satellite having multiple transponders transmitting signals at prescribed nominal center frequencies and with different polarizations, control means for energizing the motor to move said antenna along a predetermined satellite-searching path, a receiver for receiving the incoming signals from the antenna and successively tuning to the center frequencies at each of a succession of intervals along the searching path, means responsive to the signals detected by the receiver for producing a signal or value representing the quality of the detected signals at each of the successive intervals along the searching path, and means responsive to the quality-representing signal or value for identifying the locations along the searching path at which the antenna receives signals from a satellite.

23 Claims, 8 Drawing Sheets

FIG. 6
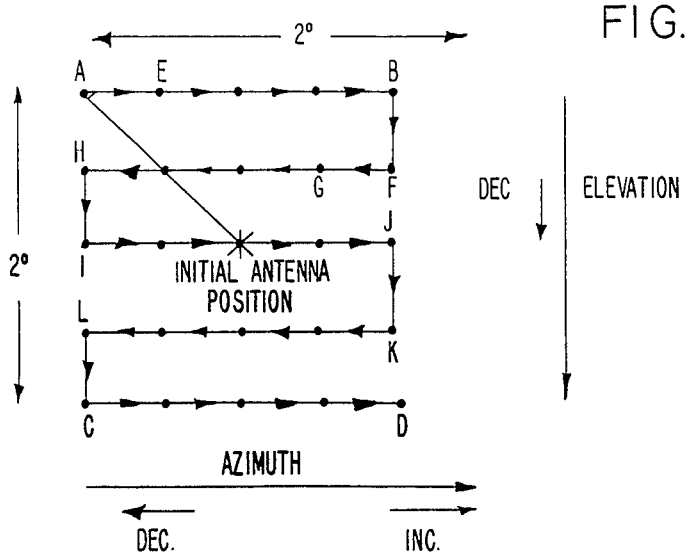
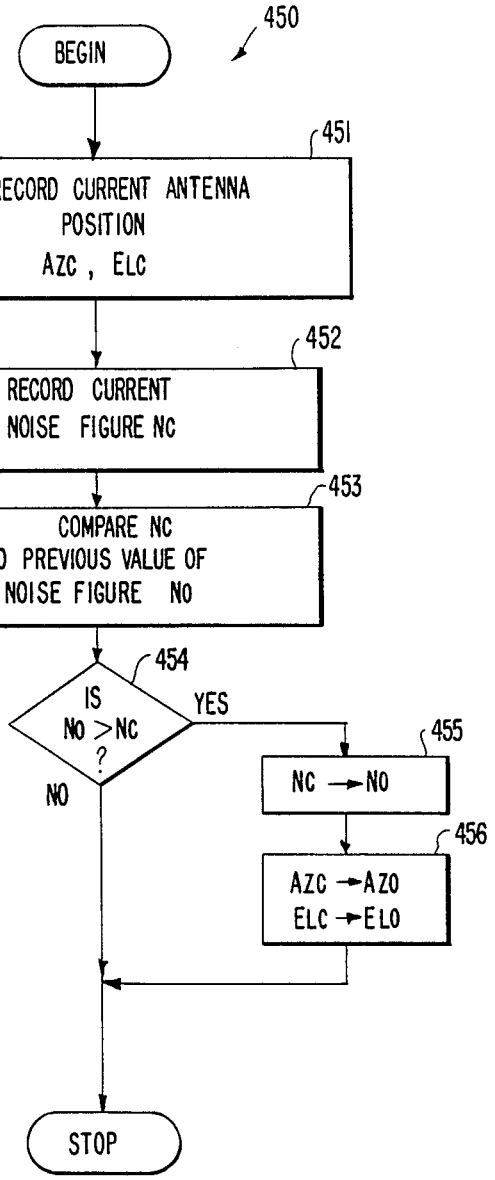
FIG. 7

SATELLITE SEEKING SYSTEM FOR EARTH-STATION ANTENNAS FOR TVRO SYSTEMS

BACKGROUND OF THE INVENTION

This invention generally relates to communication systems such as TVRO's for the reception of audio and/or video transmission signals broadcast from a plurality of orbiting earth satellites. More particularly, the invention relates to a earth-station antennas and techniques for accurately positioning them for the reception of signals broadcast on one or more channels by geosynchronous orbiting satellites, for reproduction on TVRO's or similar systems.

In satellite communication systems, a transmitting earth station generates a modulated carrier in the form of electromagnetic fields up to a satellite, forming an "uplink". The incident electromagnetic waves are collected by the satellite, processed electronically to reformat the modulated carrier in some way, and retransmitted to receiving earth stations, forming "downlinks." The earth stations in these systems basically consist of a transmitting and/or receiving power station functioning in conjunction with an antenna subsystem and form strategic parts of the satellite communication system.

In earth stations, particularly the receive-only type such as TVRO's, the antenna and the way in which its orientation is controlled plays a very important role especially with the rapidly increasing number of orbiting satellites being positioned in today's communication satellite systems. Antennas for receive-only earth stations, such as conventional TVRO systems, have to be extremely directional and must be capable of being oriented with increasing accuracy in order to track and differentiate among signals from satellites that are spaced increasingly closer together. Misorientations of the order of even fractions of a degree can mean the difference between perfect reception of a required channel and total loss of reception altogether. This makes manual positioning of earth-station antennas extremely bothersome and inaccurate.

The increased positional accuracy also has to be complemented with simplicity and convenience in locating orbiting satellites; especially so because of the rapidly increasing number of private individuals or consumers using TVRO systems to receive television transmissions directly from orbiting satellites. The projection of TVRO systems or similar compact earth station terminals into the consumer electronics market has raised the need for an efficient satellite-seeking technique for antennas used with such systems, which is together simple, fast, accurate and, in particular, lends itself easily to automation so that the end user can conveniently control the antenna sub-system to receive the channel of his choice from any commercially broadcasting orbiting satellite.

SUMMARY OF THE INVENTION

It is the general object of this invention to provide a method for the seeking of orbiting satellites with increased accuracy using earth station antennas.

It is a related object of this invention to provide such a method in a form that is significantly faster than conventional manual or mechanical satellite seeking techniques for antennas.

A further object of this invention is to provide such a satellite-seeking method in a form which can be conveniently automated in order to make the whole process of looking for a satellite, orienting the antenna for good reception on all channels, and reorienting to another satellite automatic.

Other objects and advantages of the invention will be apparent from the following detailed description and the accompanying drawings.

In accordance with the present invention, a TVRO receiving system is provided with a satellite seeking system comprising at least one controllable motor for adjusting the position of an antenna for receiving signals from a satellite having multiple transponders transmitting signals at prescribed nominal center frequencies and with different polarizations, control means for energizing the motor to move the antenna along a predetermined satellite-searching path, a receiver for receiving the incoming signals from the antenna and successively tuning to the center frequencies at each of a succession of intervals along the searching path, means responsive to the signals detected by the receiver for producing a signal or value representing the quality of the detected signals at each of the nominal center frequencies at each of the successive intervals along the searching path, and means responsive to the quality-representing signal or value for identifying the locations along the searching path at which the antenna receives signals from a satellite.

The quality-representing signal or value preferably includes information representing the signal-to-noise ratio of the signals detected by the receiver, such as the noise level of those signals, and may also include information representing the signal strength within a narrow bandwidth at each of the center frequencies.

One particular embodiment of the invention uses three different levels of seeking with different degrees of resolution. The highest level, called the Level 1 seek, has the highest resolution and is used by the antenna to search within a predefined small patch of the "sky" for the best reception of one of the channels (typically 24 in current satellite communication systems) receivable from a particular satellite, once the antenna points in the expected vicinity of the satellite. The search is made in alternating azimuthal and elevational increments of the antenna position starting from a point approximately centered on the predefined patch, and the detected signal at the demodulator stage of the TVRO is monitored for the lowest noise as the patch is scanned to determine the position of best reception.

The succeeding level is the Level 2 seek which is basically a repeat of the Level 1 seek with the difference that the predefined patch is comparatively larger than in Level 1, and the seek here is done for each of the 24 channels receivable from a given satellite as well as for different polarization angles in each channel. Level 2 also ensures that there is no overlapping in succeeding patches that are scanned. In Level 2 the indication of the presence of a satellite is the reception of video signals on any channel, and a Level 2 seek is stopped whenever the operator sees what he considers to be a video image; otherwise the level 2 seek is continued until the entire predefined patch is scanned.

The lowest level is the Level 3 seek which functions to provide non-overlapping physical movements in order to avoid repetitious area seeking. Level 3 is basically used to move level 2 around in a predefined pattern whenever a satellite is initially being searched for. Level 3 is called upon to initiate a new Level 2 seek when a Level 2 search does not turn up a receivable satellite.

The above technique provides simple, convenient, accurate and easily automated satellite seeking as described below in detail.

BRIEF DESCRIPTION OF THE DRAWINGS

The invention and other objects and advantages thereof, may best be understood by referring to the following detailed description in conjunction with the accompanying drawings, in which:

FIG. 6 is a diagram of a preferred search pattern for use with the Level 1 seek according to this invention;

FIG. 7 is a flow chart of the sort procedure used as part of the Level 1 seek at each incremental position of the satellite antenna along the search pattern of FIG. 6;

DESCRIPTION OF THE PREFERRED EMBODIMENTS

Although the invention will be described in connection with certain preferred embodiments, it will be understood that it is not intended to limit the invention to those particular embodiments. On the contrary, it is intended to cover all alternatives, modifications and equivalent arrangements as may be included within the spirit and scope of the invention as defined by the appended claims.

Figure 1:
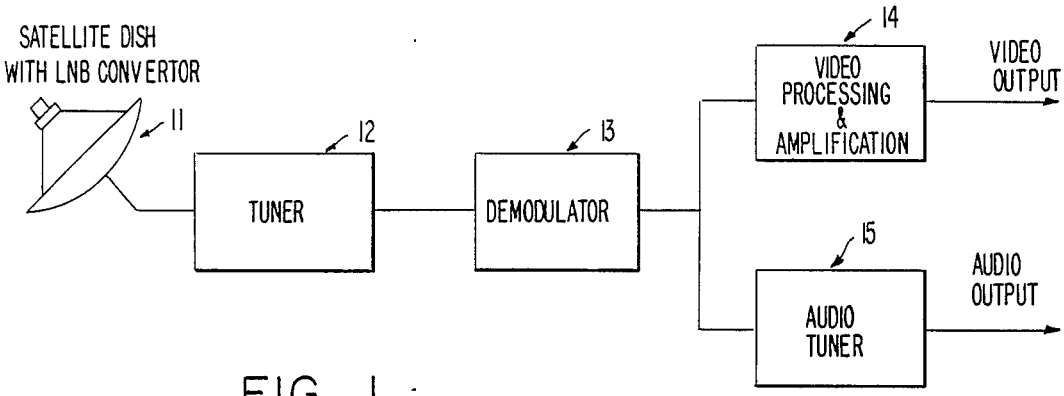
FIG. 1 is a simplified block diagram of a conventional TVRO earth terminal showing the basic sections comprising the TVRO.

Referring now to the drawings, in FIG. 1 there is shown a functional block diagram of a TVRO earth station for the reception of satellite signals. The system includes an antenna 11, which is typically a paraboloidal dish equipped with a low noise block (LNB) converter and related accessories and positioning mechanisms, for capturing signals transmitted from orbiting satellites; and a receiver system including a tuner 12, a demodulator 13, a video processing and amplification section 14, and an audio tuner 15.

The antenna 11 receives signals transmitted from the satellite in the 4-GHz frequency band (3.7 to 4.2 GHz); and this entire block of frequencies is converted to a 1st IF frequency range of 950 to 1450 MHz by the block converter located at the antenna site. The 1st IF signals are then sent via coaxial cable to the tuner 12 which selects a particular channel for viewing and converts the signals in that particular channel to a 2nd IF frequency range. The 2nd IF frequency range is preferably high enough to permit the 2nd IF VCO frequencies to be above the 1st IF block of frequencies, to prevent the VCO from interfering with the desired signals. For a 1st IF frequency range of 950 to 1450 MHz, this means that the center frequency of the second IF frequency range must be at least 500 MHz. A particularly preferred 2nd IF center frequency in the system of the present invention is 612 MHz.

In the demodulator 13, the 2nd IF signal is passed through an amplifier and a filter and on to a conventional video detector which demodulates the frequency-modulated signal to the baseband of the original video signal (e.g., 0 to 10 MHz), producing a composite video signal output. The filter preferably has a pass band that is only about 22 MHz wide; a pass band of this width passes the essential video and audio information while rejecting unwanted noise received by the antenna on the edges of the selected channel.

The output of the demodulator comprises the baseband signals which range from DC to about 8.5 MHz; this includes video information from about 15 KHz to 4.2 MHz, and subcarriers from about 4.5 to 8.5 MHz.

Figure 2:
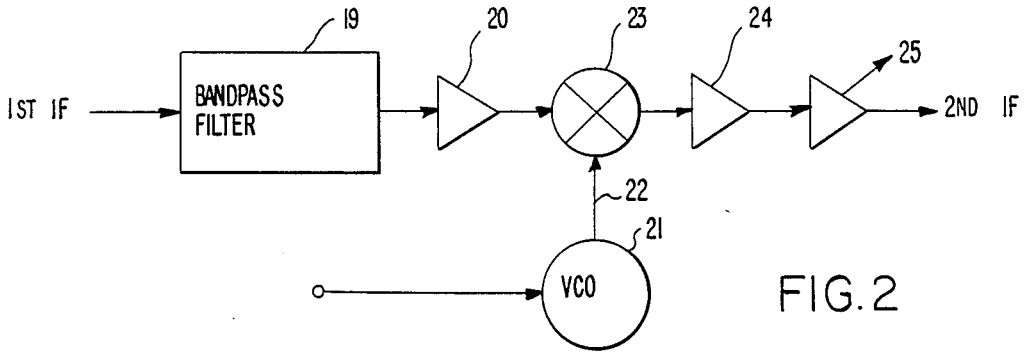
FIG. 2 is a block diagram of a preferred tuner system for use in the tuner block of FIG. 1.

FIG. 2 shows a simplified block diagram of a suitable tuner 12 for use in the TVRO system of FIG. 1. This tuner 12 includes a passband filter 19 having a passband that is 500 MHz wide (to pass signals in the 1st IF range of 950 to 1450 MHz). From the filter 19, the 1st IF signals are passed through a preamplifier 20 to a superheterodyne circuit including a voltage-controlled oscillator (VCO) 21 receiving a controlling input voltage on line 22, and a mixer 23 for combining the output of the VCO 21 with the 1st IF output of the amplifier 20. This converts the 1st IF signals to a desired 2nd IF frequency range. The resulting 2nd IF signals are passed through a pair of amplifiers 24 and 25 and then on to the demodulator 13.

By adjusting the controlling input voltage supplied to the VCO 21 via line 22, different channels (frequency bands) in the 1st IF signals are centered on the center frequency of the 2nd IF output of the mixer 23. Each channel typically contains at least a video carrier signal, a color subcarrier signal, and an audio signal at different prescribed frequencies. These carrier and subcarrier signals for all the channels are transmitted simultaneously from the satellite to the earth station antenna 11 and then over a cable to the tuner 12.

The following "Table I" is a list of the center frequencies for 24 transponders on a single satellite. Table I also lists the corresponding center frequencies in the output from the block converter (identified in Table I as the 1st IF center frequencies) and the output frequencies required from the VCO 21 in order to tune the receiver to each individual transponder. It will be noted that the difference between the 1st IF center frequency and the corresponding VCO output frequency for each transponder is 612 MHz, which means that the center frequency of the 2nd IF output from the mixer 23 is 612 MHz for every transponder. That is, the VCO output frequencies listed in Table I will cause the 612-MHz output frequency of the mixer 23 to be centered on the corresponding 1st IF center frequency. For example, a VCO output frequency of 2042 MHz will cause the 612-MHz output frequency of the mixer to be centered on the 1430-MHz 1st IF center frequency of transponder No. 1. A preferred system for controlling the input voltage to the VCO 21 to produce the desired output frequencies listed above is described in Ma et al. co-pending U.S. patent application Ser. No. 792,784, filed 10-30-85, for "TVRO Earth Station Receiver for Reducing Interference and Improving Picture Quality."

TABLE I

| Transponder Number ("Channel") | Transponder Center Freq. | 1st IF Center Freq. | VCO Output Freq. | 2nd IF Center Freq. |
|---|---|---|---|---|
| | 3720 MHz | 1430 MHz | 2042 MHz | 612 MHz |
| 2 | 3740 | 1410 | 2022 | 612 |
| 3 | 3760 | 1390 | 2002 | 612 |
| 4 | 3780 | 1370 | 1982 | 612 |
| 5 | 3800 | 1350 | 1962 | 612 |
| 6 | 3820 | 1330 | 1942 | 612 |
| 7 | 3840 | 1310 | 1922 | 612 |
| 8 | 3860 | 1290 | 1902 | 612 |
| 9 | 3880 | 1270 | 1882 | 612 |
| 10 | 3900 | 1250 | 1862 | 612 |
| 11 | 3920 | 1230 | 1842 | 612 |
| 12 | 3940 | 1210 | 1822 | 612 |
| 13 | 3960 | 1190 | 1802 | 612 |
| 14 | 3980 | 1170 | 1782 | 612 |
| 15 | 4000 | 1150 | 1762 | 612 |
| 16 | 4020 | 1130 | 1742 | 612 |
| 17 | 4040 | 1110 | 1722 | 612 |
| 18 | 4060 | 1090 | 1702 | 612 |
| 19 | 4080 | 1070 | 1682 | 612 |
| 20 | 4100 | 1050 | 1662 | 612 |
| 21 | 4120 | 1030 | 1642 | 612 |
| 22 | 4140 | 1010 | 1622 | 612 |
| 23 | 4160 | 990 | 1602 | 612 |
| 24 | 4180 | 970 | 1582 | 612 |

Figure 3:
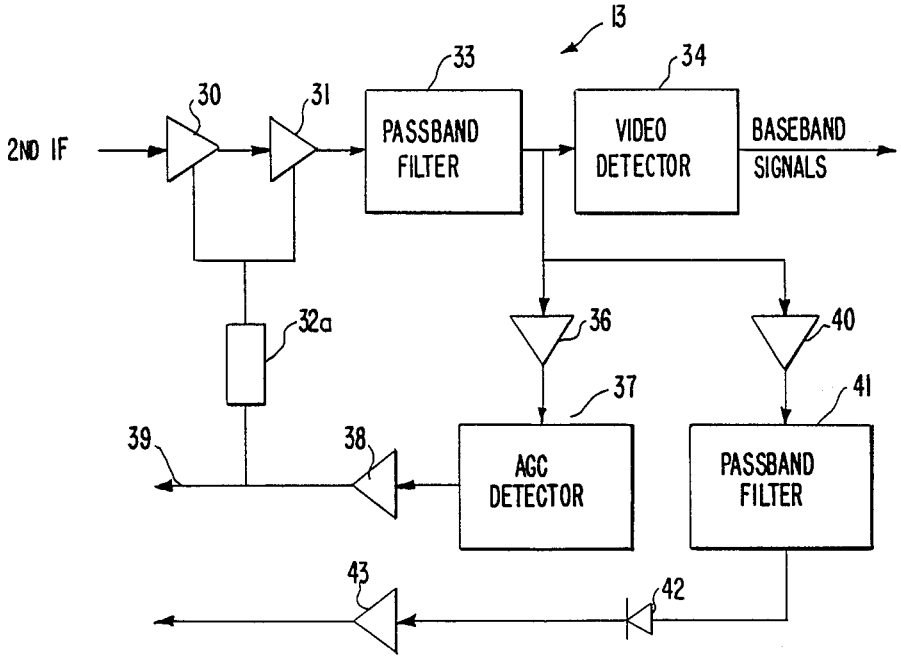
FIG. 3 is a block diagram of a preferred demodulator for use in the demodulator block of FIG. 1.

FIG. 3 is a block diagram of a demodulator 13 for receiving the 2nd IF output of the tuner 12 in the TVRO system of FIG. 1. This demodulator circuit includes a pair of conventional IF amplifiers 30 and 31 for receiving the 2nd IF signal from the final amplifier 25 in the tuner 12. Both of these amplifiers 30 and 31 receive an automatic gain control (AGC) signal from an input terminal 32. From the amplifier 31, the 2nd IF signal is passed through a filter 33 and on to a conventional video detector 34 which demodulates the frequency-modulated signal to the baseband of the original video signal (e.g., 0 to 10 MHz), producing a composite video output signal. The 2nd IF filter 33 preferably has a pass band that is only about 22 MHz wide; a pass band of this width passes the essential video and audio information while rejecting unwanted noise received by the antenna on the edges of the selected channel.

The AGC feedback loop includes an IF amplifier 36 which amplifies the output of the filter 33 and supplies it to an AGC detector 37. The output of this detector 37 is passed through an AGC amplifier 38, which produces a signal strength meter drive signal at a terminal 39. This signal strength meter is usually located on the front panel of the TVRO receiver.

The illustrative demodulator also includes an IF amplifier 40 which receives the same input supplied to the video detector 34, amplifies it, and passes it through a narrow passband filter 41. The output of the filter 41 is passed through a detector in the form of a diode 42. The signal passed by the diode 42 is smoothed by an amplifier 43 to produce a DC output voltage that can be used to detect the presence of a signal near the center frequency of the particular satellite channel to which the receiver is tuned.

The output of the demodulator illustrated in FIG. 3 comprises the baseband signals which range from DC to about 8.5 MHz; this includes video information from about 15 KHz to 4.2 MHz, and subcarriers from about 4.5 to 8.5 MHz. The video information in these baseband signals is passed through the video processing and amplification section 14 before being displayed on a video monitor or television set, and the audio signals are passed through the audio tuner 15 and then on to one or more speakers which convert the signals to audible sound.

Figure 4:
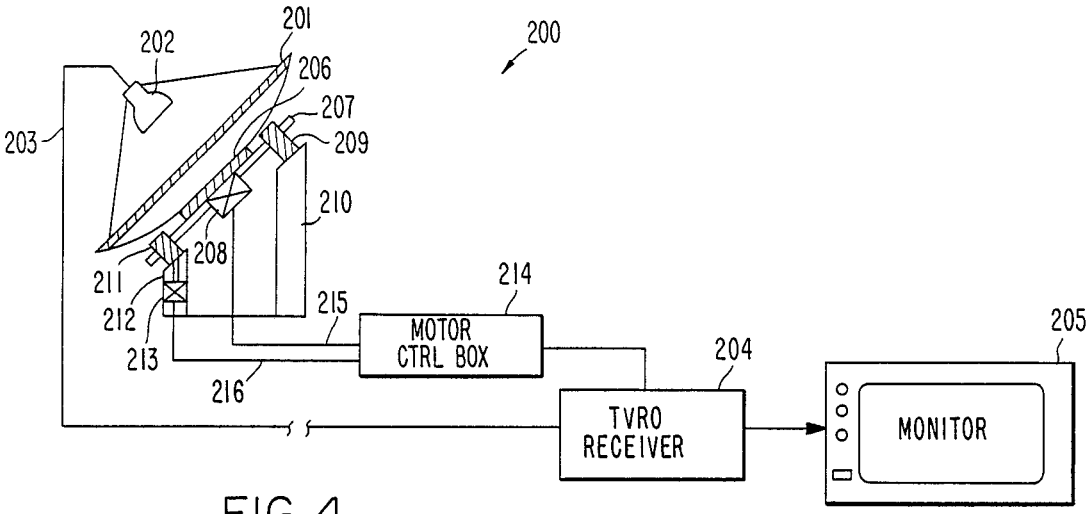
FIG. 4 is a simplified block diagram of a TVRO earth station terminal including the antenna positioning system with which this invention may be conveniently used.

FIG. 4 is a representation of a typical TVRO earth station 200 including the antenna positioning system, with which the method of the invention may be used to advantage. As shown, the earth station 200 basically consists of a paraboloidal reception antenna 201 for capturing the satellite television signals, broadcast in the form of a modulated carrier, and focusing them onto a feed horn 202; a low-loss coaxial cable 203 for transferring the received signals from the antenna to a TVRO receiver 204 which processes the modulated signals into a displayable format and performs various other control functions; and a conventional audio/video monitor 205 for reproducing the originally broadcast transmission.

FIG. 4 also shows a common way of mounting the reception antenna 201 which allows easy movement along both the azimuthal and the elevational directions. Specifically, the antenna 201 is mounted through a swivel mechanism 206 to a support rod 207. The extent of swivel motion or azimuthal placement of the antenna is controlled by an electric motor 208 which is connected by a suitable linkage to the swivel mechanism. The support rod 207 is mounted on its end remote from the ground, through a thrust bearing or hinge joint 209, to a vertical member 210 usually of fixed height. On its end closer to the ground, the support axle 207 is mounted through another thrust bearing or hinge joint 211 to a second vertical member 212. This member 212 is of controllable height, with an electric motor 213 mounted so as to be capable of adjusting the height of the member 212 and hence the degree of slant or elevation of the antenna 201.

The above type of mounting, generally referred to as a "polar mount", has the advantage that if the support rod is aligned along a true North-by-South line and the elevation adjusted for a heading which is truly southerly, no further adjustments in elevation are required in order to track the complete belt of geo-stationary orbit satellites. The provision of the two motors for easily controlling variations in azimuth as well as elevation makes the positioning system versatile and especially applicable to the satellite seeking method according to the system of this invention.

The extent of the revolutions of the two motors 208 and 213 is measured by special motor pulse extraction circuits within a motor control console 214, to which the motors are connected via supply and sense lines 215 and 216, respectively. The pulse extraction circuits use the commutation pulses of the motors as a reference to provide an accurate measurement of the number of revolutions undergone by the motors in a given direction and hence the relative change in the position of the satellite antenna. A detailed description of such a circuit is presented in co-pending Ma et al. U.S. patent application Ser. No. 771,667, filed Sept. 3, 1985, for "Motor Pulse Extraction System". The information relating to the revolutions of the motors 208 and 213 provides an accurate record of the azimuthal and elevational changes, respectively, which the antenna 201 undergoes. This data is fed to a microprocessor in the TVRO receiver 204 and is processed to be used as a part of the satellite seek procedure to be described below.

Figure 5:
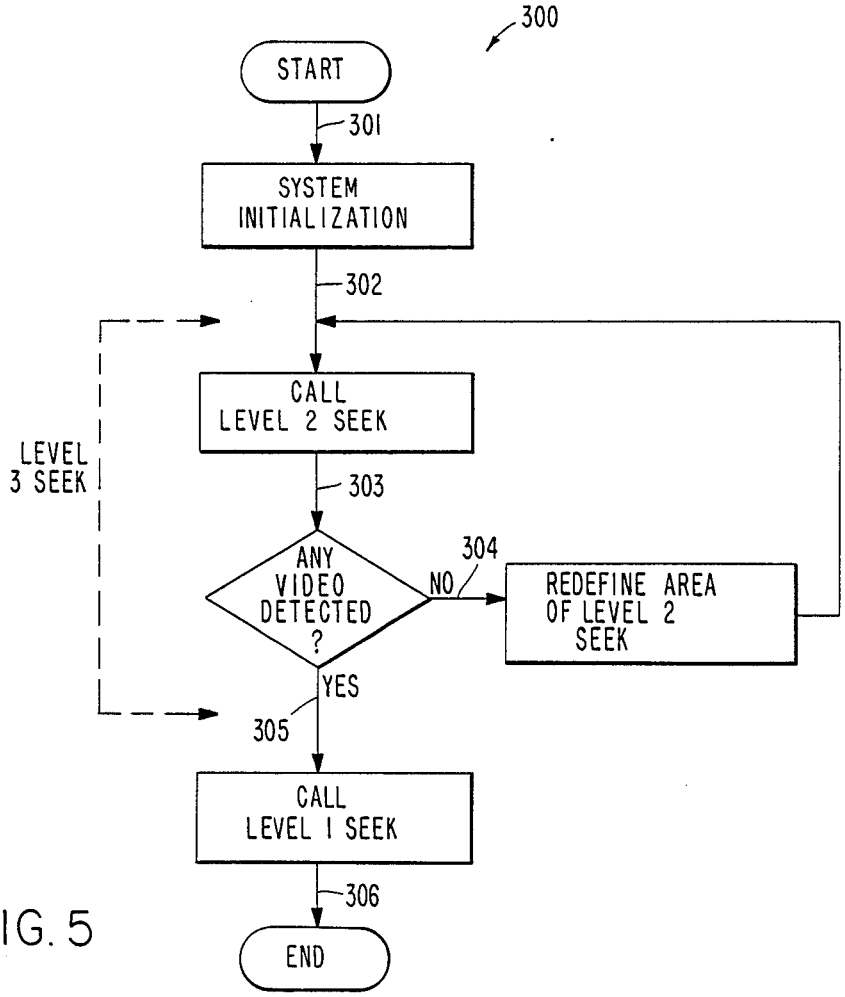
FIG. 5 is a flow chart of the steps involved in the overall search procedure according to the system of this invention.

Referring now to FIG. 5, there is shown a flowchart 300 of the overall search procedure executed by a software program controlling a conventional microprocessor in the receiver 204. The first step 301 is where system initialization takes place and includes the referencing of all system variables involved in the satellite seeking system. Of importance here are the parameters relating the motor controls to the current position of the satellite dish. Also falling within the scope of the system initialization step 301 is the initial setting up of the satellite dish so that it is oriented in the general direction of the geo-stationary satellite orbit belt. This can be accomplished by the use of currently available computer charts that provide the location of every geo-stationary satellite that is within line of sight of given geographic coordinates.

For example, for a geographic location directly above the north pole, all North American domestic relay television satellites are located within the geo-synchronous orbit belt from 70 degrees west to 140 degrees west. Using such information, the satellite earth station antenna can be positioned so that it is approximately oriented toward a known satellite location.

After the above arrangements have been completed, step 302 is accessed, which in combination with steps 303 and 304 constitutes the Level 3 seek which is explained in detail below with reference to FIGS. 12 and 13.

Step 302 uses the Level 2 seek procedure (described below in connection with FIG. 11) to search within a predefined area for video signals corresponding to any of the satellite channels. At step 303, a check is made to determine whether any video signals have been detected by the Level 2 seek procedure. If the answer at step 303 is negative, step 304 is reached where the search area for the Level 2 seek is redefined to an adjacent non-overlapping location before reverting to step 302 where a Level 2 seek is reiterated.

If the answer at step 303 is in the affirmative, that is, some trace of discernable video has been found by the Level 2 seek procedure, step 305 is accessed, which involves a high resolution Level 1 seek in order to determine the precise position of the antenna dish for optimum reception of signals from the satellite in question.

Each of the three levels of seek represented in FIG. 5, referred to hereinafter as "L1", "L2" and "L3", are described in detail below using their respective flow charts and search patterns.

FIG. 6 shows the search pattern for the L1 seek procedure, which is the procedure providing the highest degree of resolution.

The initial part of the L1 seek consists of keeping the antenna at its current position and measuring the noise figure of the received signals. It can be safely assumed that the antenna, during an L1 seek, is oriented in the direction of a receivable satellite because the L1 seek is called in for fine tuning the antenna position only after an L2 seek has located signals from a receivable satellite. Subsequently, all the available channels are scanned, without changing the antenna position, and the system determines which channel, and which polarization angle within that channel, provide optimum reception.

After the optimum channel and polarization angle are found, the L1 seek conducts a search within a predefined area for the antenna position that provides the best reception of this channel. That position then represents the best orientation of the satellite antenna for the reception of all channels from the satellite in consideration. As shown in FIG. 6, the search area is defined by a square ABDC having sides 2° long in both azimuth and elevation, with the initial antenna position in the center of the square. The search is started by moving the antenna to point A at the upper left corner of the square, and then along the path shown by the arrows in incremental steps of half a degree in either the azimuthal or the elevational direction. At each new incremental position, a measurement is made for the noise figure related to the channel being scanned. A comparison is made at each step to determine the lowest of the measured noise figures. Each time a comparison is made, the higher noise figure is discarded and the lower noise figure and the satellite position corresponding to it are stored. In this way, when the search reaches the end of the search pattern, i.e., at point D, the current stored value of the noise figure and corresponding antenna position represent the lowest noise figure and the best position of the satellite antenna for the reception of the selected channel and hence the satellite under question.

FIG. 7 is a flowchart of the "sort" procedure 450 used by the Level 1 seek at each incremental position of the satellite dish along the search pattern of FIG. 6. This procedure 450 begins at step 451 which reads the current antenna position as represented by the current azimuth value $AZ_c$ and the elevation value $EL_c$. At the next step 452, the current value $N_c$ of the noise figure of the incoming signal is read and stored.

Figure 8:
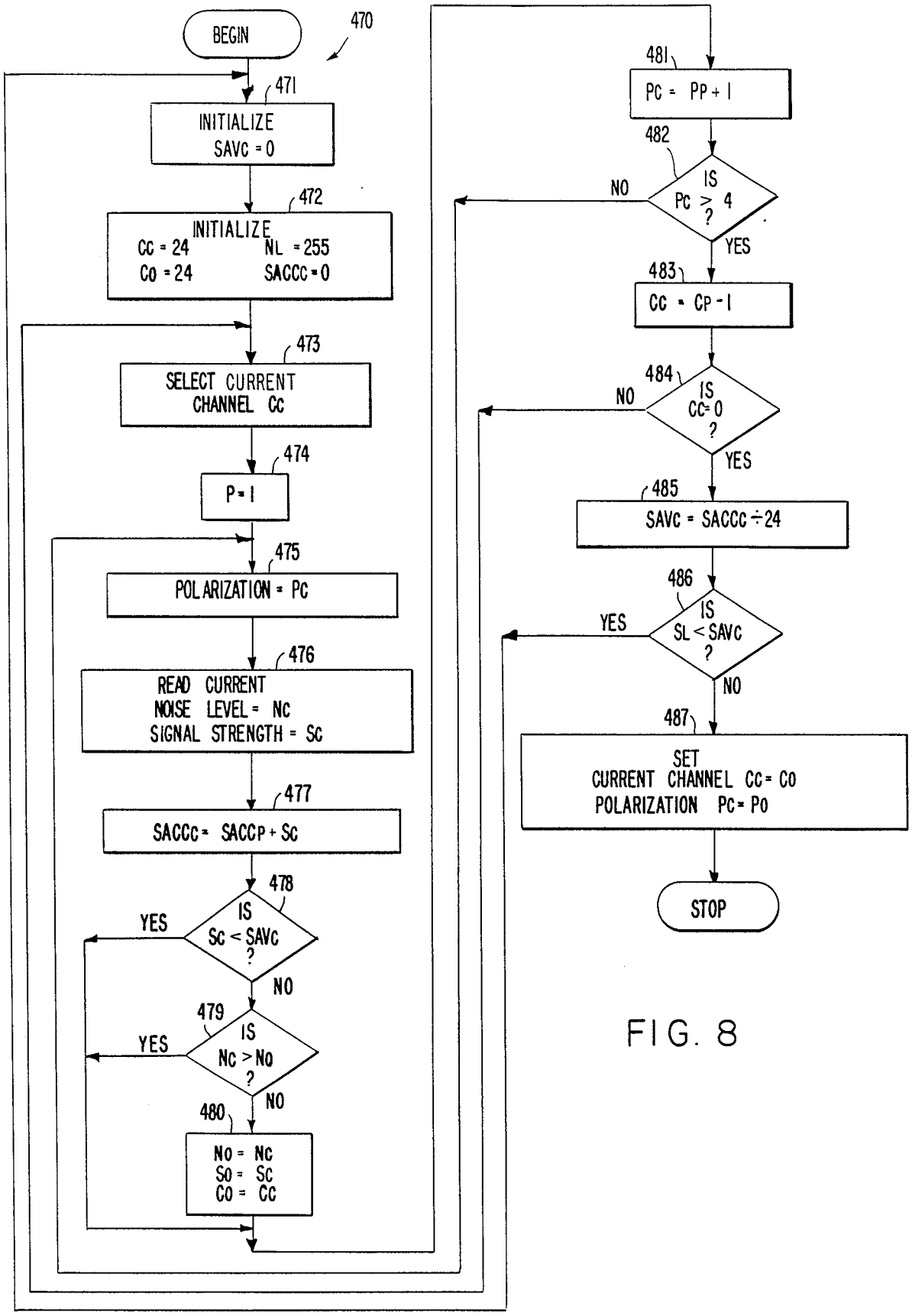
FIG. 8 is a flow chart of the scan procedure used as part of the Level 2 seek according to the system of this invention.

At the succeeding step 453, a comparison is made between the current noise figure value $N_c$ and the previously recorded value $N_o$, and step 454 then determines whether $N_o$ is greater than $N_c$. If the answer at step 454 is affirmative, i.e., the previous noise figure is greater than that of the measurement, the present noise figure value $N_c$ is substituted for $N_o$ at step 455. At the next step 456, the present azimuthal and elevational position values $AZ_c$, $EL_c$ are also substituted for the previously stored azimuthal and elevational positions $AZ_o$ and $EL_o$. If the answer at step 454 is negative, i.e., the comparison of step 453 shows that the previously stored noise figure value $N_o$ is less than the value $N_c$ just measured, steps 455 and 456 are bypassed so that there is no change in the stored values $N_o$, $AZ_o$ and $EL_o$ FIG. 8 shows a flow chart 470 for the initial stage of the Level 1 seek. As described above this "scan 2" procedure involves the selection of the strongest receivable channel and the best mode of polarization for this channel, with the antenna aimed in the direction in which it was aimed when the Level 1 seek was called for.

The initial steps 471 and 472 initialize the loop variables $SAV_c$, $C_c$, Co, No and $SACC_c$ which respectively represent the current average signal strength, the current channel, the best channel, the noise figure of the best channel, and the current accumulated signal strength of all channels.

At step 473, the current channel value $C_c$ is read, and at step 474 the current polarization value $P_c$ is set to 1.

The value $P_c$ is then used at step 475 to set the polarizer to a predetermined polarization angle. With the TVRO system now tuned to a known channel and set at a known polarization angle, the current noise figure value $N_c$ and signal strength value $S_c$ are read at step 476 (an exemplary system for producing the noise figure values will be described below). Step 477 then updates the value $SACC_c$ by adding the current signal strength value $S_c$ to the previous value $SACC_p$, so that the stored value $SACC_c$ always represents the accumulated signal strength of all the channels measured up to any given time.

To determine whether the current signal strength is above or below the average signal strength, step 408 determines whether $S_c$ is less than $SAV_c$. If the answer is affirmative, the system advances directly to step 481 where the current polarization value $P_c$ is incremented by one. A negative answer at step 478 advances the system to step 479 which determines whether the current noise figure $N_c$ is greater than the lowest previously measured noise figure value $N_o$. If the answer is affirmative, the system again proceeds directly to step 481. A negative answer at step 479 advances the system to step 480 where the current values $N_c$, $S_c$ and $C_c$ are all substituted for the previously stored values $N_o$, $S_o$ and $C_o$, and then advances to step 481.

Following the incrementing of the value $P_c$ at step 481, step 482 determines whether or not the polarization value is greater than four. This particular system is designed to test only four polarization angles in each channel, but of course this number could be varied to increase or decrease the sensitivity of the system to different polarization angles. An affirmative answer at step 482 indicates that the desired number of polarization angles have been tested in the current channel, and thus the channel value $C_p$ is decremented by one at step 483. Step 484 determines when the current channel value $C_c$ reaches 0, which is an indication that all channels have been selected. It will be recalled that the value $C_c$ was initialized at 24, which means that 24 channels must be tested before an affirmative answer is produced at step 484. Of course, with satellites having a greater or lesser number of transponders, the initialized value of $C_c$ can be changed accordingly.

A negative answer at step 482 returns the system to step 475 so that steps 476 through 482 are repeated for the same channel but with a different polarization angle. A negative response at step 484 returns the system to step 473, thereby causing steps 474 through 484 to be repeated for a new channel, and for the desired number of different polarization angles within that channel.

After all channels of a given satellite have been tested, as indicated by an affirmative answer at step 484, the average signal strength of all the channels is computed at step 485 as a value $SAV_c$, which is the value $SACC_c$ (representing the accumulated single strength of all twenty-four channels) divided by twenty-four. Step 486 then determines whether the stored value $S_o$, representing the signal strength of the best of all the channels, is less than the average signal strength value $SAV_c$. If an affirmative answer is obtained at step 486, the system returns to step 471 and repeats the entire procedure. A negative response at step 486 advances the system to step 487 where the current values $C_c$ and $P_c$ are set equal to the stored values $C_o$ and $P_o$ representing the best channel and the best polarization angle for that channel.

Figure 9:
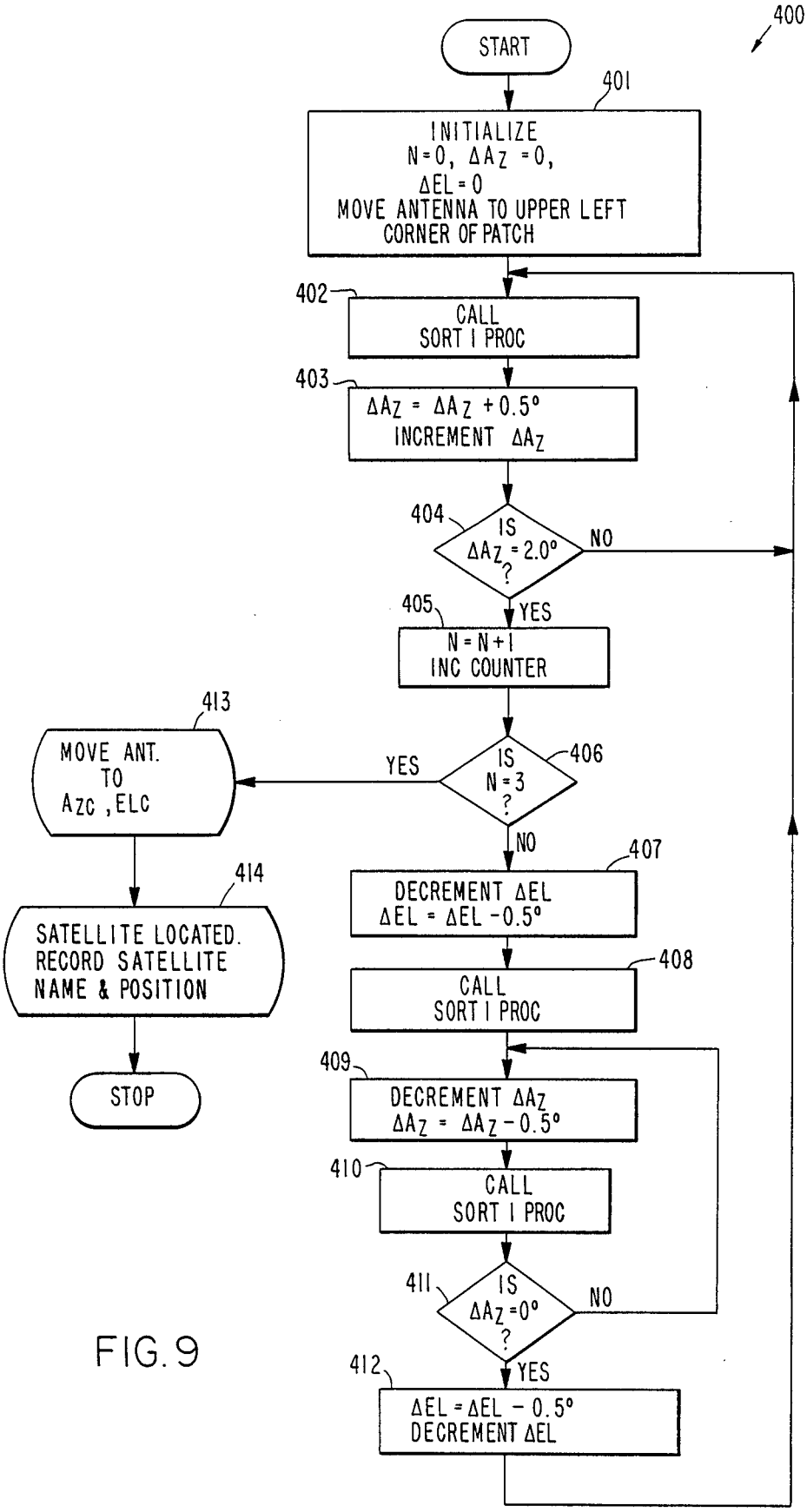
FIG. 9 is a flow chart of the main stage of the Level 1 seek according to the present invention.

FIG. 9 is a flow chart 400 of the main stage of the Level 1 seek. Prior to the beginning of this stage, the procedure of FIG. 7 has been used to identify the strongest channel receivable from the particular satellite at which the antenna is pointed.

In the main stage of the Level 1 seek, the satellite antenna is moved along the search pattern defined by FIG. 6 in order to accurately locate the position which provides the best reception of the particular channel identified by the procedure of FIG. 7. This position will then provide the optimum orientation of the antenna for receiving all channels from this particular satellite.

In FIG. 9 the first step 401 moves the antenna to the upper left corner of the square to be searched and initialzes a pair of incremental counters ΔAZ and ΔEL which track the stepwise changes in the position of the satellite antenna in azimuth and elevation, respectively. A loop counter N is also initialized.

At step 402, the "sort 1" procedure is called into the program. This is the procedure of FIG. 7 and includes the comparison of noise figures of the received signal at the current antenna position and the previous antenna position, and retention of the lower noise figure and corresponding antenna position for further comparison.

At step 403 a half degree increment is added to the azimuthal increment counter. This represents a physical movement in the position of the satellite antenna of 0.5 degrees along the azimuth. More specifically, the antenna is now aimed toward a point E which is half a degree to the right of the starting point A in FIG. 6, with no change in elevation. At step 404, a check is made to determine whether the azimuthal limit of the Level 1 search pattern (see FIG. 6) has been reached. This limit corresponds to a value of the azimuth incremental operator ΔAZ equal to 2°. If the answer at step 404 is negative, i.e., the satellite has yet to reach the azimuthal limit B of the search pattern, the program reverts to step 402 to continue scanning at half-degree intervals until the end point B is reached, at which time the answer at step 404 becomes affirmative.

At step 405 the loop counter N is incremented by one, followed by a check to see if the counter has reached a value of 3, whose significance is explained below. For the first pass through the main loop, the answer at step 406 will be negative, which advances the system to step 407 where the elevation incremental operator ΔEL is decremented by half a degree. This corresponds to a physical movement in the position of the satellite antenna of half a degree in elevation. More specifically, the antenna is now oriented toward a point F which is half a degree lower in elevation than the earlier point B.

At step 407 the "sort 1" procedure described above is called again to evaluate the quality of the signal reception at the current antenna position (point F). Step 409 then decrements the operator ΔAZ by half a degree which represents a physical movement in antenna position of half a degree in azimuth. More specifically, the antenna is now aimed toward a point G which is half a degree displaced from the earlier point F along the decreasing direction of azimuth. At step 410 the "sort 1" procedure is again called into operation to evaluate the signal quality at point G. Then step 411 determines whether the azimuthal limit of the search pattern has been reached. This azimuthal limit is the end point H, which is reached when the value of the azimuth incremental operator ΔAZ is equal to zero. If the answer at step 411 is negative, indicating that the antenna has not yet reached the azimuthal end point H, the program reverts to step 409 to continue scanning at half degree intervals until the end point H is reached. When step 411 yields an affirmative answer, the program accesses step 412.

At step 412 the elevation incremental operator is decremented again by half a degree, which as described above corresponds to a physical movement in the antenna position of half a degree in elevation so that the antenna is aimed toward a point displaced by half a degree in elevation from point H. The program then reverts to step 402 to reiterate the seek procedure. During this second pass through the main loop the satellite scans along a path traced out by points I→J→K→L→C. The loop counter reaches a value of 2 during this second pass, the answer at step 406 is still negative, and the antenna continues scanning as in the first pass to finally end up at point C at the end of the second pass.

The third pass of the program begins with the "sort 1" procedure (step 402) at point C and continues at half degree intervals until the azimuth incremental operator ΔAS has reached a value of 2.0 (steps 402, 203, 406), i.e., the azimuth limit or end point D of the Level 1 search pattern is reached. During this third pass, the incrementing of the loop counter at step 405 results in a value of 3, step 406 yields an affirmative answer, and step 413 is accessed.

It must be noted that the "sort" 1 procedure, as described above with reference to FIG. 7, performs comparisons to detect and store the lowest noise figure and the corresponding antenna position. Hence, at the end of step 406, the currently stored value of the antenna position, which corresponds to the lowest measured noise figure, represents the optimal position of the satellite antenna for receiving the channel selected by the procedure of FIG. 8. At step 413, the antenna position is shifted to this optimal position and an indication is given at step 414 to show that the desired satellite has been accurately located. At this point the located satellite can be identified on the basis of received program content and named. The coded name is stored along with the optimal antanna position for automatic repositioning of the antenna in the future.

Figure 10:
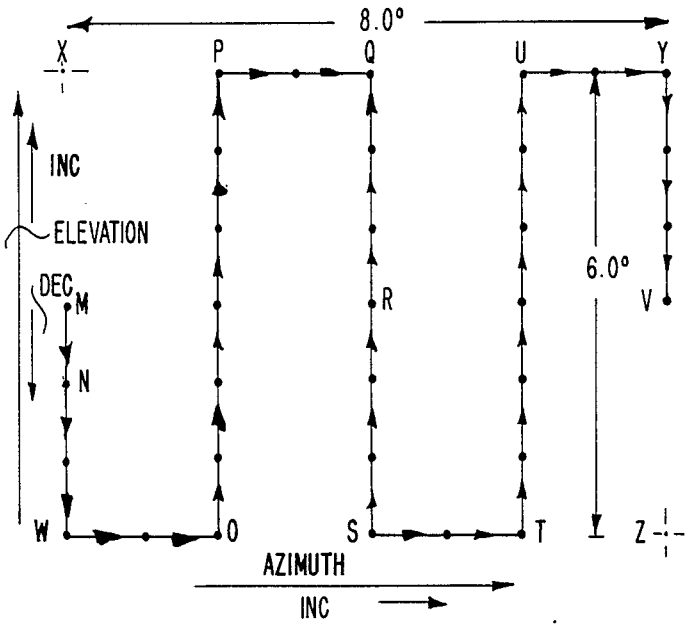
FIG. 10 is a diagram of a preferred search pattern for use with the Level 2 seek according to this invention.

FIG. 10 shows the search pattern for the Level 2 seek procedure. As noted above the Level 2 seek has less resolution than the Level 1 seek and uses a larger search pattern, as defined in FIG. 10 by the rectangular area XYZW with sides of 8 degrees and 6 degrees along the azimuth and the elevation, respectively. The search in this case is started at the midpoint M of the side XW of the search pattern, and continued along the path shown by the arrows in incremental steps of one degree in the elevational position and two degrees in the azimuthal position of the antenna dish.

At each new incremental position, all the 24 possible channels from a satellite receivable within the search area are scanned rapidly, at all polarization angles. A comparison is made at each step to determine the lowest noise figure from all the channels and all polarization angles. At the end of the comparison the channel with the lowest noise figure is latched onto until comparisons for the next incremental position of the antenna can be made. The basic goal of the Level 2 seek is to scan the search pattern for any discernible video indicating the presence of a satellite. Further optimization of the antenna position is then carried out by the Level 1 seek procedure described above.

The presence of any video signal on any particular channel and at any particular polarization angle can be ascertained in many ways. The simplest way is to let a human operator interface with the receiver system during the Level 2 seek and manually push a given control button whenever he sees a semblance of an image on the receiver monitor. An automatic but more complex way is to use a built-in artificial intelligence type of pattern recognition system which recognizes the presence of a video image on the receiver monitor screen. In either case, whenever the presence of a video image is sensed, the Level 2 seek can be interrupted to perform the high-resolution Level 1 seek.

If the Level 2 search pattern is completed without detecting any video signals, the Level 2 seek can be continued in an adjacent non-overlapping search pattern. This is facilitated by the choice of a symmetrical path for the Level 2 search pattern. For example, in FIG. 10, the search pattern starts at the mid-point M of the side XW and ends at the midpoint V of the side YZ. The next Level 2 seek can hence be conducted directly from point V without any overlapping of search patterns, and without leaving a gap between successive search patterns.

Since the purpose of the Level 2 seek is just to detect the presence of a satellite within a predefined area, without actually locating it accurately, the comparison of noise figures is performed at wider intervals than in the Level 1 seek. For instance, the increments in the elevational direction are one degree and increments in the azimuthal direction are two degrees each. The choice of the two- degree azimuthal increments is dictated by the FCC regulation stipulating a minimum spacing of two earth degrees between orbiting satellites for communications systems. If the antenna increments its azimuthal position more than two degrees at a time, there is a risk of missing a satellite altogether. By using wider increments than the Level 1 seek, the Level 2 seek provides an extremely rapid means of scanning through all channels at all desired polarization angles to detect the presence of a satellite.

Figure 11:
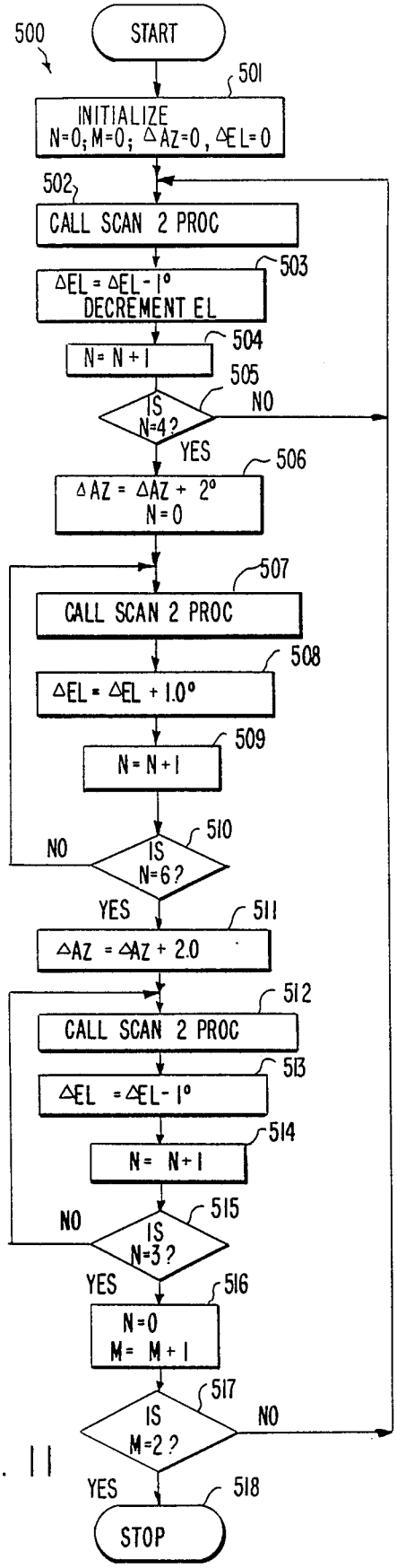
FIG. 11 is a flow chart of the Level 2 seek procedure describing how scanning for satellite signals is conducted along the predefined search pattern of FIG. 10.

FIG. 11 is a flowchart 500 of the steps followed by the Level 2 seek procedure in scanning for satellite signals along the predefined search pattern of FIG. 10. The first step 501 of the procedure initializes system variables such as the azimuth incremental counter ΔAZ and the elevation incremental counter ΔEL, which control the stepwise changes in the position of the satellite antenna in azimuth and elevation, respectively. Loop counters N and M are also set to zero at this step. The search procedure starts at point M of the search pattern (FIG. 10), and at step 502 the "scan 2" procedure of FIG. 8 is called into the program to determine the channel and polarization angle that produce the lowest noise level.

At step 503, the elevation incremental counter ΔEL is decremented by one degree. This represents a physical movement in the satellite position of one degree in elevation. More specifically, the antenna is now aimed toward a point N which is displaced from point M by one degree in elevation, without any change in azimuth.

At step 504 the counter N is incremented, and then step 505 determines whether the elevational limit of the Level 2 search pattern (FIG. 10) has been reached. This limit corresponds to a value of the loop counter N equal to 4 since the elevation side of the search pattern is 6° in length and the 1° incremental search is started at the midpoint of the side. If the answer at step 505 is negative, the program returns to step 502 and the scanning is continued at incremental steps of one degree until the point W is reached. At point W the answer at step 505 becomes affirmative, which advances the system to step 506 where the azimuth incremental operator ΔAZ is incremented by 2°. This represents a physical movement in the position of the antenna of 2° along the azimuth. More specifically, the antenna is now aimed toward point O which is displaced by 2° in azimuth from the previous point W, without any change in elevation. Further, at step 506, the loop counter N is initialized to zero in order to conveniently use it for further searching, as described below.

At step 507 the "sort 2" procedure is called again. At step 508 the elevation incremental operator ΔEL is incremented by one degree, which produces a change of 1° in the elevational position of the antenna. The counter N is then incremented at step 509, and step 510 determines whether the upper elevational limit of the Level 2 search pattern has been reached. This limit corresponds to a loop counter value of 6, since the elevation side of the search pattern is 6° in length. If the answer at step 510 is negative, the program returns to step 507 and the scanning procedure is continued in incremental steps of one degree until the point P is reached. At this point, step 510 yields an affirmative response, which advances the system to step 511 where the azimuth incremental operator is incremented again by 2°. This effectively repositions the antenna so that it is aimed toward point Q which is displaced by 2° in azimuth from the previous point P.

At step 512 the "scan 2" procedure is again recalled into the program, and the loop counter N is reset to zero. The elevation incremental operator ΔEL is then decremented by one degree at step 513, resulting in a change of one degree in the elevational position of the antenna. The loop counter N is then incremented at step 514, and step 515 determines whether the search has reached the midpoint R of the elevation side QS of the search pattern. This limit corresponds to a loop counter value of N=3. If the answer at step 515 is negative, the program reverts to step 512 and the 1° incremental search is continued until the midpoint R is reached. At this point, the answer at step 515 is affirmative and step 516 is reached.

The search pattern of FIG. 10 can be symmetrically split into two segments. The first one, as tracked by the program so far, comprises the path traced by points M, W, O, P, Q, and R. The second segment is identical to the first, except for a displacement in azimuth, and comprises the path traced by the points R, S, T, U, Y and V. Hence, to scan along the second segment the program described so far can be repeated using the point R as the starting point.

Accordingly, at step 516, the loop counter N is initialized to zero and the loop counter M is incremented to mark the end of scanning of the first segment. Step 517 determines whether the second segment has also been scanned as indicated by a counter value of M=2. If the answer at step 517 is negative, the program returns to step 502 and continues the incremental search along the second segment until the end point V of the search pattern is reached. At this point the answer at step 517 is in the affirmative and step 518 marks the end of the Level 2 seek.

It will be noted that the choice of search pattern is important for the proper functioning of the Level 2 seek procedure. It must be chosen in such a way that the succeeding Level 2 seek may be implemented immediately at the end of the previous one without allowing any overlapping or skipping of the search area. For example, at the end of a Level 2 seek, according to the search pattern of FIG. 10, the antenna is oriented toward point V, and the succeeding Level 2 seek can be started at point V without any overlapping or skipping of the search area.

Figure 12:
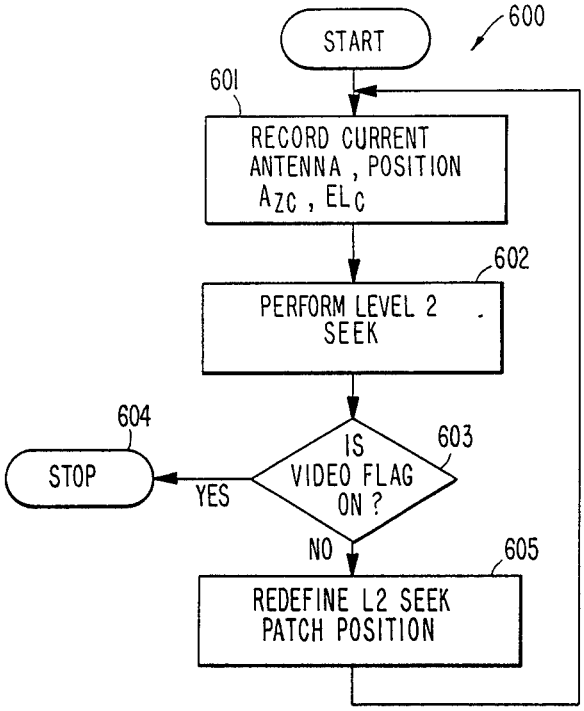
FIG. 12 is a flow chart of the Level 3 seek according to the present invention.

FIG. 12 is a flow chart of the Level 3 seek procedure according to the system of this invention. As mentioned above, the Level 3 seek procedure involves the positioning of the satellite antenna in order to perform Level 2 seeks, according to the Level 2 search pattern, at adjacent non-overlapping positions until a receivable satellite signal is detected.

Accordingly at step 601, the current physical position of the antenna is recorded in terms of azimuth and elevation readings $AZ_c$ and $EL_c$. At step 602 a Level 2 seek is performed at the current antenna position. Step 603 then determines whether a video flag is set, indicating the detection of a video transmission by the Level 2 seek. If the answer is affirmative, the program reaches step 604 where either come to a halt until a Level 1 seek is specifically called for or it may proceed automatically with a Level 1 seek centered at the antenna position where the video transmission was detected. If the answer at step 603 is negative, i.e., the Level 2 seek has produced no discernible video signals at the current antenna position, the Level 2 seek is repositioned at an adjacent but non-overlapping location at step 603, and the program returns to step 601 to continue with the satellite search procedure.

Figure 13:
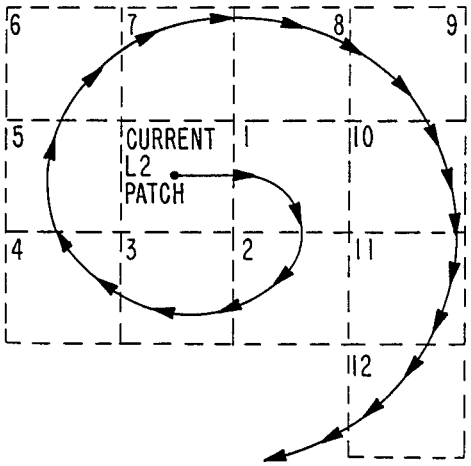
FIG. 13 is a diagram showing a preferred way of repositioning the Level 2 search pattern as part of the Level 3 seek.

FIG. 13 shows one possible way of implementing the Level 3 search. In the absence of any detected video signals after completing any Level 2 seek, the Level 2 seek search area or patch is moved from its current patch to an adjacent and non-overlapping patch 1. This repositioning is continued along a spiraling path as defined in part by patches 2 through 12. Hence, beginning with the initial position at which the Level 3 seek is started, the satellite antenna is made to track the sky along a predefined, gradually expanding and non-overlapping spiral path until a Level 2 seek detects the presence of video signals. At this point a Level 1 seek may be called to zero in on the satellite broadcasting the video signals, or until the physical constraints on the motion of the antenna are reached.

It will be noted that all positioning and referencing of the antenna as part of the overall satellite seek procedure are based on the extent of revolution of the two positioning motors as referenced by the pulse count at the motor control block of FIG. 4. At the start of the search procedure, the pulse counters for the two motor pulse extraction systems are initialized so that all further movement of the antenna may be referenced conveniently. All subsequent changes in the azimuthal and elevational readings are tracked and recorded by the microprocessor within the TVRO receiver system.

Whenever an optimum position for a particular satellite is found, it is stored, in terms of the number of pulses that the motors are displaced from the reference position. Thus, the antenna may be conveniently and automatically repositioned to be oriented directly toward the same satellite whenever needed. In case there is any displacement from the optimum position (due to mechanical error or any other problem) during repositioning of the antenna towards a satellite whose position has been discovered and recorded earlier, the basic search procedure according to the system described above can be undergone again in order to redefine the optimum position of the antenna for the satellite in question.

By following the procedure outline above, the earth station antenna can be used to successively seek all satellites broadcasting commerically from the geo-synchronous orbit belt, and to record the optimum antenna positions for the respective satellites in terms of the displacement of the positioning motors. Once such a database of satellite antenna positions is set up, locating a satellite or shifting from one satellite to the other automatically is a simple matter of recalling the appropriate antenna position from the database in memory and then controlling the positioning system to properly orient the antenna. If needed, fine tuning of the antenna position can be performed as mentioned above, and the new antenna position can be used to update the earlier position recorded within the database.

Figure 14:
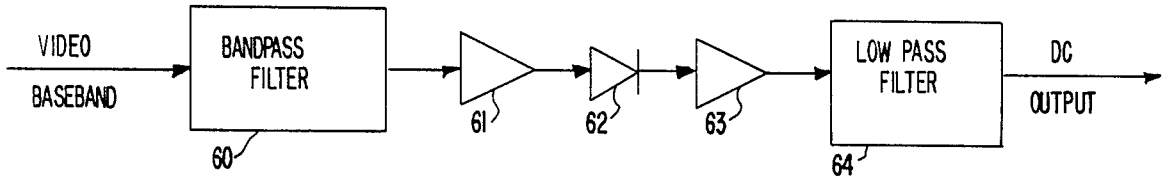
FIG. 14 is a schematic diagram of a preferred noise detector for use in the system of this invention.

FIG. 14 shows the details of a preferred noise detector for furnishing the microprocessor with the noise figure values referred to above. In this particular detector the video baseband signal from the demodulator 13 is initially fed through a bandpass filter 60 which preferably has a pass band that is about 500 KHz wide centered at about 23 MHz, which is well above the video information in the baseband signal. The 23-MHz center frequency also avoids interference from 27-MHz CB signals, 21-MHz and 24.5-MHz ham radio signals, and harmonics of the 4-MHz output of the crystal oscillator in the tuner 12.

The output of the bandpass filter 60 is passed through a conventional RF amplifier 61 to a detector in the form of a diode 62. This diode 62 rectifies the AC output from the amplifier 61, and the resulting signal is smoothed by passing it through a DC amplifier 63 and a low pass filter 64. It is the smooth DC output of the filter 64 that is applied to the microprocessor via an analog-to-digital converter; the magnitude of this DC signal will vary in direct proportion to the noise level in the video baseband output from the demodulator.

The polarization angle referred to above is adjusted by a microprocessor output signal which is passed through a digital-to-analog converter to produce a DC voltage for application to a conventional polarizer. TVRO systems normally include polarizers which can adjust the relative alignment of the polarization of the incoming signals and the orientation of the antenna. One type of polarizer mechanically rotates the small probe that is included in the feed horn of most earth station antennas, by means of a small servomotor which is powered by either the indoor receiver or an antenna positioner. A second type of polarizer adjusts the polarization of the incoming signal electronically, by changing the voltage applied to a coil wound around an electromagnetic ferrite core located at the throat of the feedhorn.

As is well known, the ferrite-core polarizer essentially acts as a controlling phase shifter and has a feed horn arrangement for accepting the incoming satellite signals and then passing them through the ferrite core. When a voltage is applied across the coil, an electromagnetic field of corresponding strength is set up around the ferrite core. This field interacts with the electromagnetic fields propagating through the core and rotates the plane of polarization of the received signals to a predetermined angle corresponding to the magnitude of the DC voltage applied to the coil.

We claim:

1. A TVRO earth station having a satellite seeking system comprising at least one controllable motor for adjusting the position of an antenna for receiving signals from a satellite having multiple transponders transmitting signals at prescribed nominal center frequencies and with different polarization, control means for energizing said motor to move said antenna along a predetermined satellite-searching path, a receiver for receiving the incoming signals from said antenna and successively tuning to said center frequencies at each of a succession of intervals along said searching path, means responsive to the signals detected by said receiver for producing signals or values representing the quality of the detected signals at each of said successive intervals along said searching path, at least one of said signals representing the noise level associated with the detected signals and not representing the signal level associated with the detected signals, and means responsive to said quality-representing signals or values for identifying the position along said searching path at which the antenna receives the detected signals with a minimum noise figure.

2. The TVRO earth station of claim 1 wherein at least one of said quality-representing signals or values represents the strength of the incoming signals within a bandwidth of about 3 MHz centered on each of said center frequencies.

3. The TVRO earth station of claim 1 wherein said receiver includes a demodulator producing a video baseband output, and said quality-representing signal or value represents the noise level in said video baseband output.

4. The TVRO earth station of claim 3 wherein said noise level-representing signal or value represents the noise level at about 23 MHz in said video baseband output.

5. The TVRO earth station of claim 1 wherein said receiver includes a tuner for converting the incoming signals at said prescribed nominal center frequencies to an IF frequency, and at least one of said quality-representing signals or values represents the strength of the resulting IF signal within a narrow bandwidth at the IF center frequency.

6. The TVRO earth station of claim 1 which includes a controllable polarizer for feeding the receiver incoming signals with different selected angles of polarization, and control means for adjusting said polarizer to a plurality of different angles of polarization at each of said center frequencies, and wherein said means for producing said quality-representing signals or values produces said signal or value at each of said angles of polarization.

7. The TVRO earth station of claim 1 which includes means responsive to said quality-representing signal or value produced at each of said different angles of polarization for determining the optimum angles of polarization for the signals received from a given satellite.

8. The TVRO earth station of claim 1 which includes means responsive to said quality-representing signals or values for identifying the transponder transmitting the strongest signal from a given satellite, means for energizing said motor to move the antenna along a predetermined optimizing path with said receiver tuned to the center frequency of the transponder identified as transmitting the strongest signal, and means responsive to said quality-representing signals or values produced during the antenna movement along said optimizing path for determining the optimum antenna position for said satellite.

9. The TVRO earth station of claim 1 which includes means for storing the values of said quality-representing signals for the transponder transmitting the strongest signal for a given satellite, and means for comparing these stored values with corresponding values and substituting the new values for the corresponding stored values whenever the new values are superior to the stored values whereby said stored values always represent the best values obtained as of any given time.

10. The TVRO earth station of claim 1 wherein said searching path encompasses an azimuth range of at least 2°.

11. The TVRO earth station of claim 1 wherein said quality-representing signals include a signal representing information about the signal-to-signal ratio of the signals detected by said receiver.

12. The TVRO earth station of claim 11 wherein said information representing the signal-to-noise ratio is the noise figure of the signals detected by said receiver.

13. The TVRO earth station of claim 12 wherein said quality-representing signals include a signal representing the signal strength within a narrow bandwidth at each of said center frequencies.

14. A TVRO earth station having a satellite seeking system comprising at least one controllable motor for adjusting the position of an antenna for receiving signals from a satellite having multiple transponders transmitting signals at prescribed nominal center frequencies and with different polarizations, control means for energizing said motor to move said antenna along a predetermined satellite-searching path, a receiver for receiving the incoming signals from said antenna and successively tuning to said center frequencies at each of a succession of intervals along said searching path, means responsive to the signals detected by said receiver for producing a first signal representing the strength of the incoming signals within a narrow bandwidth at each of said center frequencies, and a second signal representing the noise figure associated with the incoming signals when the receiver is tuned to each of said center frequencies, and means responsive to said first and second signals for determining the best position of said antenna for receiving signals from a satellite, said best position corresponding to the position of the antenna and the polarization angle at which incoming signals are received with a minimum associated noise figure.

15. A method of seeking satellites using an antenna of an earth station for satellite communication systems with a plurality of geo-synchronous orbiting satellites broadcasting on a plurality of channels, said antenna being provided with remotely controllable positioning means for controlling and referencing the position of the antenna along the directions of both azimuth and elevation, the earth station being provided with a receiver system including means to ascertain the incoming signal strength and means to ascertain an associated noise figure, said method comprising the steps of:

orienting the antenna in the general direction of known satellites and searching at a low resolution level, along a predefined first search pattern within a predefined first search area, for the presence of any discernible video signals from broadcasting satellite on any of the plurality of broadcast channels and at any of a plurality of predefined incoming signal polarization angles, searching at a high resolution level, if said low resolution level detects the presence of video signals, to search along a predefined second search pattern within a predefined second search area, for the best possible position to receive signals broadcast from said satellite, said best position corresponding to the position of the antenna and the polarization angle at which incoming signals are received with a minimum associated noise figure, and successively repositioning said first search area, if said low resolution level of searching does not detect the presence of any video signals, at non-overlapping positions and continuing the satellite search with the low resolution level until the presence of some video signals in detected.

16. The method of claim 15 wherein the searching at said low resolution level is performed at incremental positions of said antenna along said first search pattern within said first search area, and seeking a satellite at each incremental position by:

scanning through said plurality of receivable channels to detect the presence of video signals, measuring the noise figure of received signals at each of said channels being scanned at each of said plurality of polarization angles, and determining the channel and polarization angle producing the lowest noise figure.

17. The method of claim 15 wherein the searching at said high resolution level includes the steps of:

scanning through said plurality of receivable channels, measuring the noise figure of received signals for each of said channels being scanned at each of a plurality of polarization angles in order to determine the strongest channel and the best polarization angle, without changing the position of the antenna, measuring the noise figure of received signals at incremental positions of said antenna along said second search pattern within said second search area, and determining the optimum position of said antenna which corresponds to the lowest measured noise figure, and positioning said antenna to said determined optimum antenna position.

18. The method of claim 15 wherein said second search area for the searching at said high resolution level is defined by a square with sides two degrees in length in both the azimuth and elevation directions.

19. The method of claim 15 wherein said first search area for the searching at said low resolution level is a rectangular area defined by sides of eight degrees and six degrees in length in the azimuth and elevation directions, respectively.

20. A method of orienting an earth station antenna for receiving telecommunication signals from a plurality of geo-synchronous orbiting satellites broadcasting on a plurality of channels, said earth station being provided with a receiver system including means for ascertaining the incoming signal strengths and means for ascertaining an associated noise figure at a plurality of polarization angles, said method comprising the steps of:

orienting the antenna in the general direction of said broadcasting satellites, successively altering the position of said antenna and the polarization angle of incoming signals along incremented positions along predefined search patterns and in predefined search areas, and measuring incoming signal strength and related noise figure at each of said incremented positions on the basis of a predefined search procedure to determined the best position for reception of signals from a given satellite, said best position corresponding to the position of the antenna and the polarization angle at which incoming signals are received with a minimum associated noise figure.

21. The method of claim 20 wherein said predefined search procedure includes first, second and third search levels, said first search level comprising a low resolution search, along a predefined first search pattern within a predefined first search area, for the presence of discernable video signals from said broadcasting satellites on any of said plurality of broadcast channels and at any of a plurality of polarization angles, said second search level being performed if said first search level detects the presence of video signals, and comprising a high resolution search, along a predefined second search pattern within a predefined second search area, for the position of said antenna at which said noise figure of incoming signals has the lowest value, and said third level being performed if said first search level does not detect the presence of video signals, and successively repositioning said first search area at non-overlapping positions.

22. The method of claim 21 wherein said first search level is performed at incremental positions of said antenna along said first search pattern within said first search area, with the seek procedure at each incremental positions including the steps of:

scanning through said plurality of receivable channels to detect the presence of video signals, measuring the noise figure of received signals at each of said channels being scanned at a plurality of polarization angles, and determining the channel and polarization angle having the lowest noise figure.

23. The method of claim 20 wherein said second search level includes the steps of scanning through said plurality of receivable channels, measuring the noise figure of received signals for each of said channels being scanned at a plurality of polarization angles in order to determine the strongest channel and the best polarization angle, without changing in the position of the antenna, measuring the noise figure of received signals at incremental positions of said antenna along said second search pattern within said second search area, and determining the optimum position of said antenna which corresponds to the lowest measured noise figure, and setting said antenna to said determined optimum antenna position.

* * * * *